United States Patent [19]

Nuesslein et al.

[11] Patent Number: 5,066,243

[45] Date of Patent: Nov. 19, 1991

[54] CONNECTOR HOUSING

[76] Inventors: Karl Nuesslein, Birkenring 9, 8835 Pleinfeld-Mischelbach, Fed. Rep. of Germany; Antonio Motta, Via Bosiso 2, Monza 20052 MI, Italy; Gerhard Schule, Kaadenerstr. 3, 8835 Pleinfeld, Fed. Rep. of Germany

[21] Appl. No.: 513,306

[22] Filed: Apr. 20, 1990

[30] Foreign Application Priority Data

Apr. 21, 1989 [DE] Fed. Rep. of Germany ..... 3913181

[51] Int. Cl.[5] ..... H01R 13/58

[52] U.S. Cl. ..... 439/460; 439/467

[58] Field of Search ..... 439/459, 460, 465, 467

[56] References Cited

U.S. PATENT DOCUMENTS 4,153,326 5/1979 Frantz et al. ..... 439/465 X
4,163,598 8/1979 Bianchi et al. ..... 439/467 X

FOREIGN PATENT DOCUMENTS

GM 1896165 11/1963 Fed. Rep. of Germany .
052424898 12/1974 Fed. Rep. of Germany .
2113365C3 8/1979 Fed. Rep. of Germany .
2934953A1 12/1981 Fed. Rep. of Germany .
8211844U1 7/1982 Fed. Rep. of Germany .

*Primary Examiner*—Eugene F. Desmond
*Attorney, Agent, or Firm*—Dena Meyer Weker

[57] ABSTRACT

Connector housing with contact element chambers, accommodating contact elements one of which is connected to the signal conductor, the other one of which is connected to a shield branched from the signal conductor. A vertical wall of the connector housing adjacent to the contact element chamber of the contact element of the shield is provided with a flap which is connected with the remaining part of the vertical side wall by means of a film hinge. The flap is provided with a cover with recesses for guiding at least one coaxial cable out of the connector housing and with a stress relieving nose which exerts pressure on the branch of the shield when the flap is closed and relieves pressure in this way.

11 Claims, 2 Drawing Sheets

CONNECTOR HOUSING

FIELD OF THE INVENTION

The invention relates to a connector housing having at least one pair of contact element chambers having a flap with a stress relieving mechanism that is engageable with the contact element chamber to relieve stress in the cable connection and maintain electrical characteristics and resist changes to wave transmission.

BACKGROUND OF THE INVENTION

Electrical connectors providing electrical connections with one or several coaxial cables generally consist of an inner conductor, an insulating layer around the latter, a shield surrounding the insulating layer, generally in the form of a braided tube and a jacket around the shield. The contact element chambers of the connector housing accommodate contact elements, the inner conductors and the shields of the coaxial cables being connected with different contact elements. Each coaxial cable is assigned a pair of adjacent contact element chambers. Two-pin connectors of this type are of rectangular shape and take up two adjacent contact element chambers. Four-pin connectors are mostly of square external cross-section and accommodate two pairs of contact element chambers. Each pair of these contact element chambers accommodates an inner conductor contact element and a corresponding shield contact element. To provide a connection between the contact elements on the one hand and, the inner conductor and the shield on the other, the insulating jacket of the cable assembly is removed from the end which is to be connected with the connector. Subsequently the shield is bent away from the insulating layer surrounding the inner conductor and is connected with the corresponding contact element.

The areas where inner conductor and shield are separated, lie exposed outside of the connector housing. In order to electrically insulate the exposed shield conductors from each other and from external conductors and to stress-relieve the ends of the cable conductors in the connector housing, the cable inlet end of the housing connected with the coaxial cables in state of the art connectors is closed off by means of a casting compound, such as a polyacrylic adhesive. This is effected in such a way that the casting compound covers the housing from the cable inlet side to the area of separation of shield and inner conductor in a convex shape.

Plug-type connectors of this kind are mostly used in telecommunications, in particular for telephone systems. The matching contacts of such plug-type connectors are connection pins mounted on circuit boards. With modern technology, the packing density of connector pins on circuit boards has become very high, the dimensions of the connectors are correspondingly small.

The contact elements are equipped with locking springs which diagonally protrude from the contact elements towards the cable connection ends. Their free ends engage behind locking shoulders formed by recesses in the corresponding inner side walls of the contact element chambers. A contact element can only be pulled out of its contact element chamber by overcoming the locking force of the locking spring. Locking is only possible when the contact element is inserted into the contact element chamber in the correct turning position relative to its vertical axis.

Since the contact elements and consequently also the locking springs are rather tiny due to the small dimensions of such plug-type connectors, it is normally not sufficient to secure the contact elements in their chambers by means of locking springs. Therefore stress is additionally relieved by casting material around the cable inlet end of the connector.

From DE-PS 21 13 365 a connector housing of the afore-mentioned kind is shown where a number of contact elements are arranged in series next to each other. A flap is connected by means of a film hinge in transverse direction to the contact element row to a wall of the connector housing in such a way that in closed position it constitutes an extension of this wall. On the inside of the flap, there are perpendicularly protruding locking ribs which engage behind each contact element in the connector housing when the flap is closed and which release the contact elements when the flap is open. Therefore the contact elements can be inserted into their chambers or taken out of the latter without problems when the flap is open. When the flap is closed, the locking ribs secure the contact elements in the housing so that they cannot be torn out of the cable inlet end of the housing. The flap can engage with the rest of the housing by means of an engaging mechanism when it is closed.

The existing connector housing is open at the cable inlet side even when the flap is closed. The locking function of the locking ribs at the flap requires that the contact elements that are inserted into the connector housing are equipped with shoulders behind which an engaging mechanism may engage.

For multi-pin plug-type connectors with two rows of superimposed contact elements, it is only the row of contact elements next to the flap which can be secured by the locking ribs of this flap. If the top row of contact elements is also to be secured so that it cannot be drawn out of the cable inlet of the connector, there are plug-type connectors facing two vertical sides which are equipped with a flap each containing locking ribs. In other words, two rows of contact elements can only be secured by means of two flaps with locking ribs.

When the contact elements are mounted in the state of the art connector housing, each contact element, which has been adapted in shape to the locking mechanism, must be in its correct turning position about the vertical axis, otherwise the locking mechanism will fail. This exact positioning of the connector housing requires a lot of care and thoroughness of work by the assembly personnel or a highly sophisticated construction of the assembly machines.

U.S. Pat. No. 3,293,591 describes a two-pin connector the housing of which is open at the cable inlet end so that pin-shaped contact elements which are connected with the free ends of two electrical cables can be pushed through a common contact element cavity into an outlet opening at the plug-in side of the connector housing. In this case the cables connected with the contact elements at first protrude from the opening at the back of the connector housing. At a narrow side wall of the connector housing there is a cover which is attached to the housing by means of a film hinge. After the contact elements have been mounted in the housing, the cover is closed by a swivelling movement. This forces the cable ends connected with the contact elements into a recess in a vertical wall of the connector housing opposite the film hinge so that they are vertically guided out of the connector housing after the cover has been closed. The inside of the cover is provided with a clamping rib by means of which the cable sections guided out of the contact elements can be held stationary in the connector housing.

This clamping mechanism may be adequate for conductors which exclusively serve to conduct electrical energy. Problems arise, however, with signal transmitting cables. Coaxial cables which are connected to connectors for the above-mentioned telephone systems are geometrically deformed when squeezed in order to relieve stress. This changes the electrical characteristics of the cable and entails an undesirable change of the wave transmitting resistance of the cable.

SUMMARY OF THE INVENTION

There is a need to provide a stress-relieving securing device for connectors of the above-described type which are mainly used for telephone systems, while upholding the basic configuration of the connector, rendering superfluous the use of casting compounds or a special contact element shape, without impairing the electrical characteristics of the cables connected to such plug-type connectors, requiring a minimum amount of accessories to conventional connectors of this type and offering easy and simple assembly.

A connector housing is provided having at least one pair of contact element chambers having a flap with a stress-relieving mechanism that is engageable with the contact element chamber to relieve stress in the cable connection and maintain electrical characteristics and resist changes to wave transmission. Specified characteristics of the flap with stress-relieving mechanism are provided including applicability with a two-pin connector and a four-pin connector.

Since according to the invention the stress relieving devices only reach into the contact element chamber for the shield conductor of a coaxial cable, and there is no such device in the area of the contact element chamber of the corresponding signal conductor, the stress-relieving mechanism only affects the separated shield of the coaxial cable. The signal conductor is only indirectly held stationary in the housing because its shield is held by the corresponding stress relieving device. Since the separated shield extends into the part of the shield which is coaxially arranged around the signal conductor, this stress-relieving mechanism is basically evenly distributed around the insulating layer. In this way the signal conductor is held stationary without being deformed by having the insulation layer crushed. Therefore neither the electrical characteristics nor the resistance to wave transmission will change.

For a connector comprising four or more pins the invention provides for separating ribs between the individual stress relieving devices to prevent electrical contact between the individual separated shields.

Since the stress-relieving mechanism acts on the separated shield and not by a mechanism engaging at the shoulder of a contact element, this stress relieving method is independent of the turning position about the vertical axis in which the contact element is mounted into the corresponding contact element chamber.

In order to mount the contact elements independently of such a turning position into the contact element chamber, it is advisable to make the locking spring of the contact element not engage with a shoulder recess at an opposite wall within the chamber but to use a particularly preferred construction and center the end of the contact element which is located at the plug-in side in line with the plug-in opening of the contact element chamber by means of inclined surfaces in the plug-in end of the corresponding chamber and to force the contact element over its entire circumference against the walls of the contact element chamber so that the free end of the locking spring can securely engage at the neighboring inner wall of the chamber, independent of the turning position in which the contact element had been inserted into the contact element chamber.

Due to these inventive steps both the locking mechanism of the contact element within the contact element chamber by means of the locking spring and the stress relieving mechanism by means of the stress-relieving nose are independent of the axial turning position in which the contact element is inserted into the contact element chamber. This is a considerable advantage, renders assembly easy and reduces assembly-related faults.

The fact that the cover is mounted to the free end of the flap prevents external connectors from contacting the shield conductors after they have been separated from the shield. The cover is provided with one or several recesses for the signal conductors of the coaxial cables. Frequently the diameter of the coaxial cables is virtually the same as the inside diameter of the contact element chambers so that the recesses for the coaxial cables are the same size as the contact element chambers. If, however, the cross-section of the coaxial cables is smaller than the inside diameter of the corresponding contact element chambers, it is preferable to adapt the recesses in the cover to the diameter of the coaxial cables and in this case to make the recesses for the coaxial cables smaller than the inside diameter of the corresponding contact element chambers.

The stress relieving mechanism described in the invention, with a stress-relieving nose which is mounted to a pivotable flap and a cover arranged at the free end of the flap and which incorporates recesses for the signal conductors allows the casting compound, which must normally be used for connectors of this type to be omitted. Furthermore, stress is relieved from the signal conductors by acting on the separated shield instead of on the signal conductor. Even when there are two parallel rows of contact element chambers a single flap with stress-relieving noses at only one side of the connector housing suffices.

In a preferable construction, the separating ribs are equipped with engagement noses at their free ends which can be engaged with correspondingly positioned engagement recesses in the housing in such a way that it can also be disengaged.

Preferably the separating walls between the individual contact element chambers end at such a distance to the cover part of the closed flap that between the ends of the contact element chambers and the cover part of the closed flap there is still enough room left for the separation of the shield from the conductor. The stress relieving noses protrude into this section.

The independence from casting compounds and from the axial turning position of the contact elements in their chambers results in a connector which offers ease of assembly at low cost.

DETAILED DESCRIPTION OF THE PREFERRED EMBODIMENTS

The invention is best understood with reference to the accompanying figures.

Figure 1:
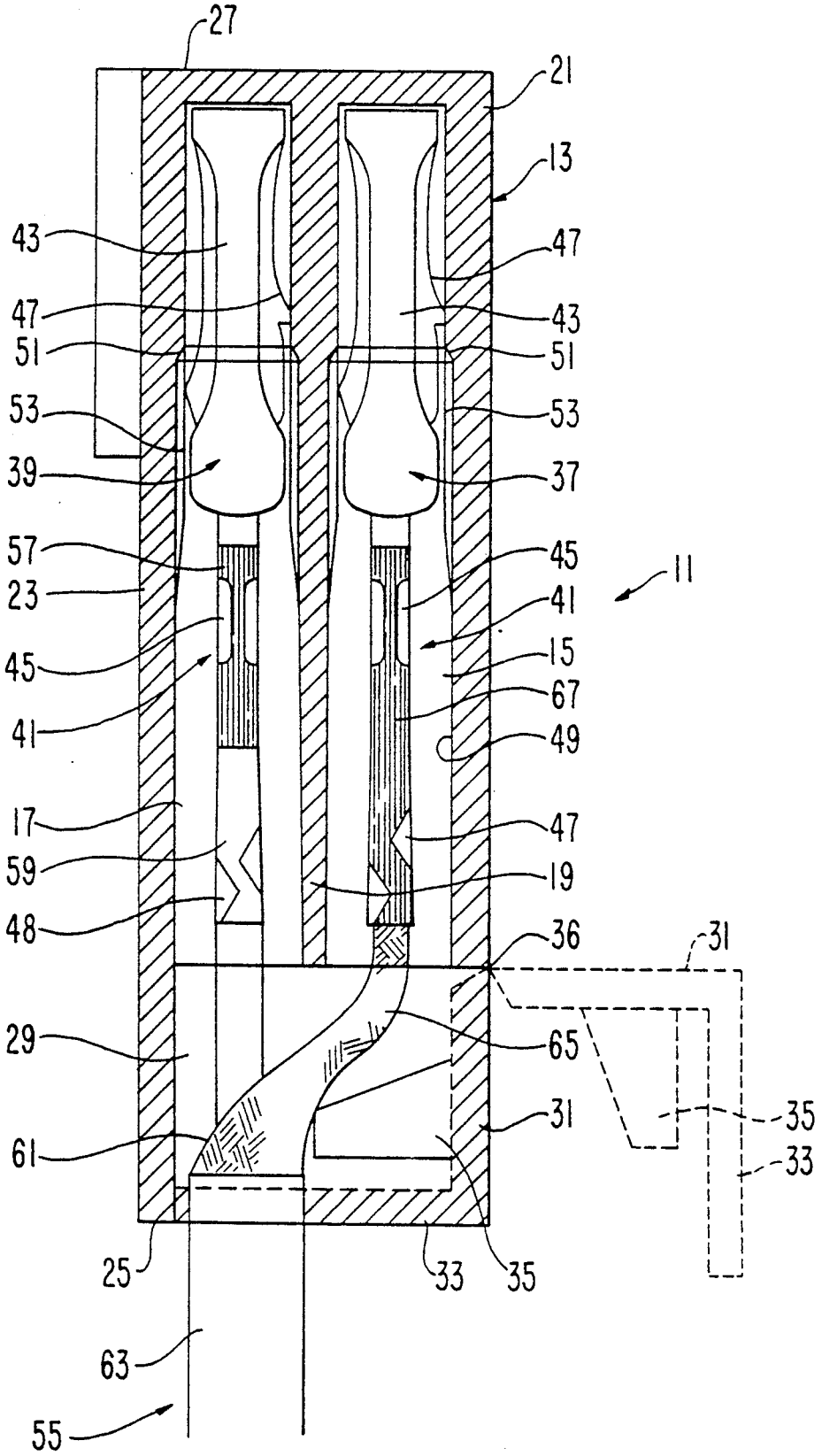
FIG. 1 shows a vertical cross-section through a connector with a housing as described in the invention.

FIG. 1 shows an embodiment of the invention in vertical cross- section. The connector 11 with a housing 13 incorporates two adjacent contact element chambers 15 and 17 which are separated by a wall 19. The separating wall 19 is shorter than the facing vertical walls 21 and 23 so that between the lower end of contact element chambers 15 and 17 and the lower cable inlet end 25 of the housing 13 there is a cavity 29 which extends over the contact element chambers 15 and 17. The vertical wall 21 shown at the right-hand side of FIG. 1 is formed with a flap 31 at its lower end. At the lower free end of the flap there is a molded one-piece cover part 33 perpendicular to the facing vertical side wall 23. At the inside of the flap a stress relieving mechanism 35 protrudes into the housing. The flap 31 is connected to the remaining part of the vertical housing wall 21 by means of a pivotable film hinge 36. The flap 31 can be swivelled about this film hinge 36 from a closed position (bold line in FIG. 1) to an open position (dotted line in FIG. 1).

Each contact element chamber 15 and 17 accommodates a contact element 37 and 39. Each contact element is provided with a connection area 41 and a pin contact area 43 in the form of a contact bushing designed for spring-supported take-up of a pin from a matching connector or a circuit board. The connection area 41 is equipped with a crimped conductor part 45 and a crimped clamping part 47. The contact elements 37 and 39 each have a locking spring 48 in the contact area 43 which diagonally protrudes from the body of the contact area towards the cable inlet side and engages with the adjacent inner vertical wall 49 of the connector housing 13. Each contact element chamber 15 incorporates a conically tapering area 51 shown in FIG. 1 in the inner wall below the locking spring 47. One contact rib each leads to this tapering section from each of the four inner walls of the rectangular shaped contact element chamber 15 and extends into the interior of the contact element chamber 15 from below the tapering section 51 (FIG. 1). Above the tapering section 51 the contact element chamber 15 is narrower than below.

The end of a coaxial cable 55 is guided into the cable inlet and 25 of the connector housing 13. The coaxial cable comprises a signal conductor 57, an insulation layer 59 which is made of an insulation material and is arranged coaxially around the latter, a shield 61 coaxially surrounding the insulating layer 59 and a jacket 63 coaxially surrounding the shield 61. The shield 61, which is normally a tubular braided material made of electrical wires, is bent away from the insulating layer 59 of the signal conductor 57 to a vertical branch 65 and guided into the contact element chamber 15. The signal conductor, 57, however, is guided into the contact element chamber 17. At the right-hand contact element 37 both the crimped section of the conductor 45 and the crimped clamping section 47 are crushed to the branched shield conductor 59 whereas at the left-hand (FIG. 1) contact element 39 the crimp section of the conductor 45 is squeezed to the signal conductor 57 and the crimped clamping section 47 to the insulating layer around the signal conductor 57. When the flap 31 is closed, the stress relieving mechanism 35 (FIG. 1) exerts pressure from below on the branch 65 of the shield 61. This prevents the shield from being drawn out of its contact element chamber 15 and relieves stress from the shield 61. Since the shield conductor is in direct contact with the coaxial cable, the stress relieving mechanism 35 indirectly also acts on the signal conductor 57. This indirect stress relieving mechanism does not at all exert a crushing pressure on the signal conductor 57 and the insulating layer 59 around the latter so that the electrical characteristics of the signal conductor remain unchanged.

When the flap 31 is swivelled into its open position, the contact elements 37 and 39 bonded to the shield conductor 61 or the signal conductor 57 can be inserted unhindered into their contact element chambers 15 or 17. During insertion the contact ribs 53 act as centering elements by means of which the pin contact areas 43 of the contact elements 37 and 39 can on the one hand be centered in line with the pin insertion openings at the plug-in end 27 of the connector housing 13 and on the other hand the pin contact areas 43 are sufficiently pressed against all vertical walls of the corresponding contact element chambers 15 to make sure that the free ends of the locking spring 47 contact one of the inner walls of the contact element chamber 15 or 17. When somebody tries to pull the contact element 37 or 39 out of the corresponding contact element chamber 15 or 17, the free end of the locking spring 47 engages with the opposite inner wall of the corresponding contact element chamber 15 or 17. The locking mechanism at least prevents the contact elements from falling out of their chambers. However, the locking springs 47 cannot withstand any heavier tensional forces. This is why the stress relieving mechanism 35 is provided.

Figure 3:
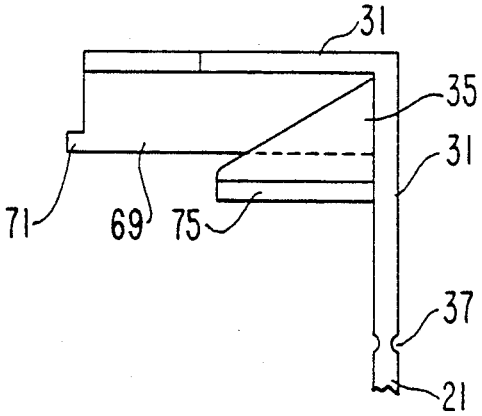
FIG. 3 shows a side view of the flap of the four-pin connector.
Figure 4:
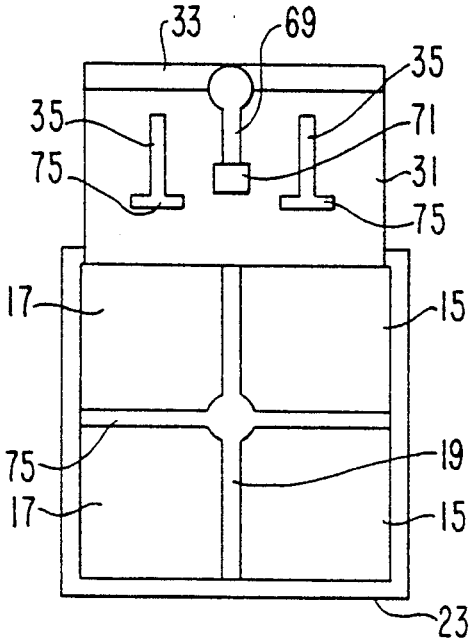
FIG. 4 shows a plan view from below of the connector housing of the connector shown in FIG. 1, four-pins, open flap.

As the stress relieving mechanism 35 interacts with the separated part 65 of the shield 61 and not with any shoulders of the contact element, stress is relieved independent of the axial turning position in which the contact element is inserted into its chamber. Furthermore, the contact ribs 53 and the tapering part of the contact element chamber make sure that the locking spring 47 can always straddle against the inner wall of the contact element chamber opposite the locking spring 47 so that the locking effect by means of the locking spring 47 is independent of the axial turning position in which the contact element is inserted into the contact element chamber. Details, in particular of the flap 31, are shown in FIGS. 2 to 4 for a four-pin connector and in FIGS. 5 to 7 for a two-pin connector.

Figure 2:
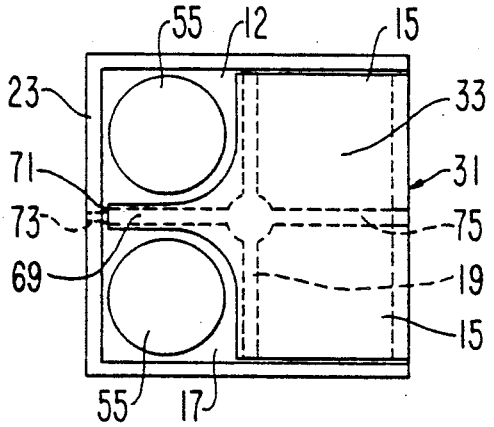
FIG. 2 shows a plan view from below of the connector shown in FIG. 1, four-pin construction with closed flap.

FIG. 2 is a plan view from below of the connector shown in FIG. 1 in a four-pin construction with closed flap 31. The cover 33 of the flap covers the two contact element chambers 15 shown at the right side of FIG. 2. These chambers accommodate contact elements (not shown in the drawing) for shields (not shown in the drawing). The two contact element chambers 17 shown at the left side of FIG. 2 accommodate contact elements (not shown in the drawing) with which the signal conductors of a coaxial cable 55 (outlined in the drawing) are connected. The cover is provided with recesses above the contact element chambers 17 so that the coaxial cables 55 can be guided through the cover 33 out of the housing 13. Between the recesses the cover 33 extends into a separating bar 69 which reaches up to the vertical side wall 23 shown left in FIG. 2. The separating bar 69 makes sure that the branches 65 of the shields 61 of both coaxial cables remain electrically separated from each other and cannot make electrical contact. Furthermore, the cover 33 prevents the free parts of shield 61 from contacting external conductors.

At its free end the separating bar 69 is provided with an engagement nose 71 which engages with an engagement opening 73 in the vertical side wall 23 shown left in FIG. 2 when the flap 31 is in closing position.

In FIG. 2 the separating wall 19 and a transversal wall 75 are indicated by a dotted line. These walls 19 and 75 divide the interior of the connector housing 13 into four contact element chambers.

FIG. 3 is a side view of the flap 31 according to FIG. 2. Here the separating bar 69 and the engagement nose 71 mounted to this bar are most clearly visible.

FIG. 4 is a view from below of the connector housing 13 shown in FIG. 1 with open flap 31.

This figure shows that transverse webs 75 are arranged at the free ends of the stress relieving mechanisms 35 to enhance the stability of the stress relieving noses 35.

Figure 5:
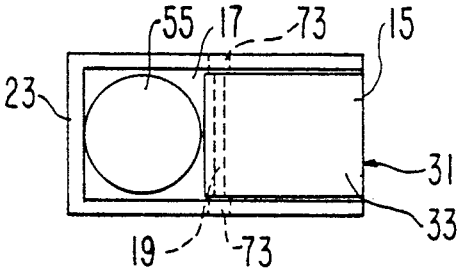
FIG. 5 shows a plan view from below of the connector shown in FIG. 1, 2-pins, with closed flap.
Figure 6:
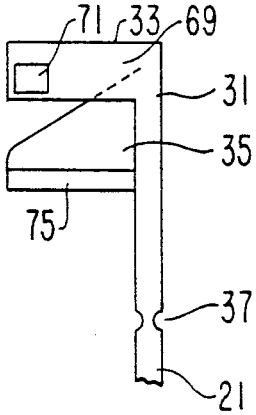
FIG. 6 shows a side view of the flap of a two-pin connector.
Figure 7:
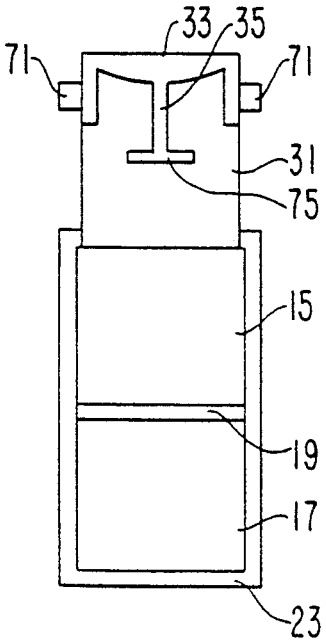
FIG. 7 shows a view from below of the connector housing of the connector shown in FIG. 1, two-pin construction with open flap.

The details of a two-pin connector housing shown in FIGS. 5 to 7 resemble those shown in FIGS. 2 to 4, the main difference being that only two contact element chambers 15 and 17 are provided so that the flap 31 incorporates only one stress relieving nose 35 in its center. The cover part 33 of the flap 31 only reaches slightly above the right-hand contact element chamber 15 in order to leave space for the coaxial cable 55 above the contact element chamber 15 shown at the left side of FIG. 5.

Since in this construction the cover 33 does not reach up to the vertical wall 23 shown at the left side of FIG. 5, there is one vertically protruding engagement nose 71 each at the vertical sides of the cover. These noses engage with the matching engagement openings 77 in the corresponding vertical walls of the connector housing 13 when the flap 31 is in closed position.

We claim:

1. A connector housing having vertical walls made of an insulating material, comprising a plurality of contact element chambers to take up in each chamber a contact element connected to an electrical conductor, the connector housing provided with a flap at one of its vertical walls, the flap being connected to the vertical wall by means of a film hinge which allows pivoting between a releasable locking position wherein the flap is an extension of the vertical wall and an open position in which it protrudes from the vertical wall, constructed in such a way that at least one stress relieving nose protrudes from a cable inlet side of the connector housing in order to prevent a contact element located in a contact element chamber adjacent to the flap to be drawn out of the cable inlet side of the connector housing when the flap is in locking position and in order to allow the contact element to be inserted into the contact element chamber and the contact element to be removed from the contact element chamber via the cable inlet side of the connector housing when the flap is in an open position, characterized in that the connector housing has at least one pair of contact element chambers arranged parallel to each other in the direction of the stress relieving mechanism and in that the stress relieving mechanism is arranged in such a way that it narrows or engages behind the contact element chamber adjacent to the flap and in that the free end of the flap is equipped with a cover which protrudes from its interior side and closes the cable inlet side of the housing when the flap is in closing position, leaving open only an opening for an electrical conductor.

2. Connector housing according to claim 1, wherein the housing incorporates a space at the cable inlet side extending over the contact element chambers and that the stress relieving mechanism reaches into the housing space when the flap is in its closing position.

3. Connector housing according to claim 1, wherein a cover is provided with at least one engagement nose protruding from a free edge of the cover and engaging with a matching engagement recess in the opposite wall of the connector housing when the flap is in its closed position.

4. Connector housing according to claim 3, wherein the cover of the flap only covers the contact element chamber adjacent to the flap and leaves the other contact element chamber open.

5. A connector housing according to claim 4 for a two-pin connector, wherein the cover is equipped with one engagement mechanism each at both opposite vertical edges and in that the connector housing is provided with engagement openings at areas when the flap is closed.

6. A connector housing according to claim 1 for a four-pin connector, wherein two pairs of contact element chambers are provided which each comprise one contact element chamber adjacent to the flap and one contact element chamber opposite the flap and in that the cover covers the two contact element chambers adjacent to the flap and leaves free the two contact element chambers opposite the flap and in that from the center of the free end of the cover a separating bar protrudes towards the vertical wall of the housing opposite the flap and in that an engagement nose protrudes from the free end of the separating bar and in that the connector housing is provided with an opening to take up the engagement nose matching the latter when the flap is in closing position.

7. A connector housing according to claim 1, wherein several pairs of contact element chambers each comprise a contact element chamber adjacent to the flap and a contact element chamber opposite the flap and in that the cover covers all contact element chambers adjacent to the flap and leaves open all contact element chambers opposite the flap, and in that a separating bar protrudes from the free end of the cover wherever there is a separating wall between adjacent pairs of contact element chambers towards the vertical wall of the housing opposite the flap and in that at least one separating bar is provided with an engagement nose at its free end and in that the connector housing is provided with an opening to take up the engagement mechanism at the appropriate place when the flap is in closing position.

8. Connector housing according to claim 7, wherein each contact element chamber adjacent to the flap is assigned one stress relieving mechanism.

9. Connector housing according to claim 7, wherein each contact element chamber is of square cross-section to take up a contact element which is also of square cross-section and in that the contact element chambers are provided with inclined contact surfaces at the side where the matching contact elements are inserted, with a tapering area in the range of the contact element chambers so that the contact element of the respective chamber is centered while being inserted into the contact element chamber in line with an inlet opening for the matching contacts in the contact element chambers and in that each contact element is provided with a locking spring which protrudes diagonally and engages with the interior wall of the contact element chamber adjacent the locking spring independent of the coaxial turning position in which the contact element has been inserted into its contact element chamber due to the centering process.

10. Connector arrangement comprising a connector housing according to claim 1 having a contact element in each contact element chamber of the connector housing and at least one coaxial cable with one electrical inner conductor as signal conductor and an electrical shield separated from the signal conductor by an insulating coating around the latter. constructed in such a way that the contact element accommodated in the contact element chamber adjacent to the flap is connected with the free end of a shield of the shield conductor bent away from the insulating coating around the signal conductor and the signal conductor is connected with the contact element, which is accommodated in the contact element chamber opposite the flap, and constructed in such a way that the stress relieving mechanism exerts pressure on a branch of the shield when the flap is in closing position.

11. Connector housing according to claim 10, wherein the branch of the shield is located in a housing area extending over the contact element chambers and in that the stress relieving mechanism which reaches into this housing area when the flap is in closing position exerts pressure on the branch of the shield when the flap is in closing position.

* * * * *